US008686812B2

(12) United States Patent
Pike et al.

(10) Patent No.: US 8,686,812 B2
(45) Date of Patent: Apr. 1, 2014

(54) DATA TRANSMITTING AND/OR RECEIVING APPARATUS

(75) Inventors: Matthew Pike, Lancashire (GB); Raymond Lloyd, Lancashire (GB)

(73) Assignee: Raven Manufacturing Limited, Accrington, Lancashire (GB)

( * ) Notice: Subject to any disclaimer, the term of this patent is extended or adjusted under 35 U.S.C. 154(b) by 469 days.

(21) Appl. No.: 12/988,485

(22) PCT Filed: Apr. 20, 2009

(86) PCT No.: PCT/GB2009/000996

§ 371 (c)(1), (2), (4) Date: May 4, 2011

(87) PCT Pub. No.: WO2009/136139

PCT Pub. Date: Nov. 12, 2009

(65) Prior Publication Data

US 2011/0199170 A1 Aug. 18, 2011

(30) Foreign Application Priority Data

Apr. 19, 2008 (GB) ..... 0807196.1

(51) Int. Cl.
*H01P 5/00* (2006.01)

(52) U.S. Cl.
USPC ..... 333/208; 333/238; 333/248; 333/249

(58) Field of Classification Search
USPC ..... 333/208, 238, 248, 249
See application file for complete search history.

(56) References Cited

U.S. PATENT DOCUMENTS

2008/0238579 A1 10/2008 Okano

FOREIGN PATENT DOCUMENTS

| | | | |
|---|---|---|---|
| CA | 2320667 | A1 | 3/2001 |
| JP | 51127484 | A | 11/1976 |
| JP | 2002 076716 | A | 3/2002 |
| WO | WO 2005/0099026 | A | 10/2005 |

*Primary Examiner* — Robert Pascal
*Assistant Examiner* — Kimberly Glenn
(74) *Attorney, Agent, or Firm* — Gable Gotwals

(57) ABSTRACT

A waveguide for transmission of data signals therealong. Data signals are typically received from and/or transmitted to a remote location and subsequently passed to or emitted from the apparatus which allows the data to be processed. The waveguide includes a channel which has a cross-sectional shape, the angular orientation of which is changed at least one point along the length of the same so as to provide a waveguide which is less sensitive to interferences. The waveguide, in one embodiment, can also include recessed portions and/or ridges along the length of the channel which ensures that the waveguide can be formed in a more reliable and controlled manner.

17 Claims, 2 Drawing Sheets

DATA TRANSMITTING AND/OR RECEIVING APPARATUS

CROSS-REFERENCE TO PENDING APPLICATIONS

Figure 1A:
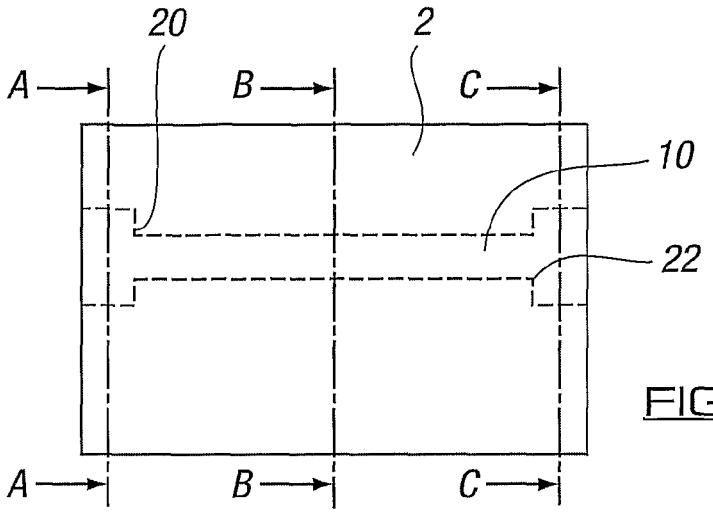

This application is the United States National Phase of PCT Patent Application No. GB2009/000996 filed on 19 Apr. 2009, which was published in English on 12 Nov. 2009 under No. WO2009/136139A2, which claims priority to Great Britain Patent Application No. 0807196.1 filed 19 Apr. 2008, both of which are incorporated herein by reference.

The invention to which this application relates is for an improvement in the form of apparatus which can be used to receive and/or transmit data at specific locations and, in particular, data which is broadcast from a remote location to the receiving apparatus. Such data can, for example, be that which is subsequently used to generate audio and/or video for radio or television programmes.

Increasingly, digital data is broadcast to be received at a plurality of locations to be subsequently processed. This data can be broadcast via cable networks or via satellite transmission systems and it is to the latter type of system to which this invention particularly relates.

The satellite transmission system includes a headend at which the data to be transmitted is generated. The appropriate data is then transmitted to at least one satellite from which the data is onwardly transmitted to be received by those antenna which are located at the correct orientation at various premises. Once received by the satellite antenna, the data signals at the appropriate frequencies are then passed to an LNB and associated apparatus and on to decoding means which allows the data to be processed and used to generate the data in the final form.

As part of the apparatus which allows the transfer of the data between the antenna and the decoding means, there is provided a waveguide which allows the passage of the data signals in a required orientation.

In order to allow the final form of the data, such as a television programme, to be in an acceptable form there is a need to ensure that the data signals are as free from errors as possible. This therefore means that the transfer of the data along the waveguide needs to be controlled. This is particularly the case where there is a need for the transfer of data in two forms or polarisations such as to allow one data signal to be used for transmission purposes and the other to be used for data receiving purposes.

In one known arrangement the waveguide apparatus is formed from two parts which are joined together. The two parts have matching formations which, when the parts are brought together, define a waveguide passage or channel along which the data signals pass. The channel or passage, in cross section is typically rectangular in shape, therefore having two opposed longer walls and two opposing shorter walls. At the interface between the two parts it is desired to have the interface parallel with the narrower walls and intersecting the wide walls. This is preferred as it makes the waveguide less sensitive to conductivity and the error or interference which this causes to the data signals. However the need to take off the data at each end of the waveguide channel in a specific polarisation often means that the orientation of the channel is such that the interface between the waveguide parts commonly intersects the narrower walls. Conventionally, the need to take off the data at the required polarisations is paramount and means that the channel or passage is provided with a greater sensitivity to conductivity and the error problems that this may cause than would be desired.

A further problem which is experienced in conventional waveguide systems is being able to join the two parts of the waveguide together to allow the same to be mechanically and conductively bonded in a satisfactory manner so as to allow the waveguide to function correctly. Conventionally this is done using a conductive sealant but the same can be difficult to apply in a controlled and repeatable manner so as to ensure that the appropriate performance of the waveguide is achieved.

The aim of the present invention is therefore to provide a waveguide of a form which is less sensitive to conductivity and therefore minimises the occurrence of interference or error in the data signals and which ensures that the data signals are available at the openings from the passage in an appropriate polarisation.

A further aim of the present invention is to provide a waveguide which can be formed in a manner which allows conductivity between the parts when joined together to form the waveguide to be achieved in a reliable and controlled manner.

In a first aspect of the invention there is provided waveguide apparatus to allow the passage of data signals therethrough, said waveguide including at least one channel along which the data signals pass, said channel including a first opening at one end and a second opening at a distal end therefrom to allow exit and entry of the data signals, at least one of said openings having a first axis longer than a second, perpendicular, axis, and wherein in at least a portion of the channel intermediate said openings the longitudinal axis of the channel in cross section is offset to the said first axis of at least one of the openings.

In one embodiment the said first axes of said respective openings are substantially parallel In one embodiment the said longitudinal axis of the channel intermediate said openings is angularly offset such as to be substantially perpendicular to the said first axis of at least one, but typically both, of the said openings.

It should be noted that the longitudinal axis is that which has the longest length between opposing sides of the channel.

In one embodiment the said longitudinal axis is in said perpendicular position along the majority of the channel length.

In one embodiment the waveguide is formed from two parts, said parts having formations such that when the parts are brought together the channel is formed. Typically the interface In one embodiment the said longitudinal axis is in said perpendicular position along the majority of the channel length.

In one embodiment the waveguide is formed from two parts, said parts having formations such that when the parts are brought together the channel is formed. Typically the interface between the parts lies along the channel. Preferably the interface intersects opposing shorter walls of the channel at and adjacent the respective openings and then intersects the opposing longer walls of the channel along the said portion of the channel.

Alternatively, the first part includes three sides of the channel and the second part provides the remaining side of the channel when it is placed in position.

Typically the channel includes at least one transition portion in which the cross sectional shape of the channel is rotated about the centre point of the channel in cross section. Typically the rotation is a rotation of 90 degrees.

Typically the channel includes two transition portions, said transition portions spaced apart along the channel. In one embodiment the respective transition portions are located adjacent to respective openings of the channel.

In one embodiment the transition portions are integral with the parts used to form the waveguide. Alternatively the transition portions are separate components which are fitted to the parts as required.

In one embodiment the size and shape of the channel is altered along its length so as to allow components, such as filters, to be formed and/or the path of the channel to be controlled, such as by providing bends.

Typically the orientation of the openings is such as to suit the particular polarisation characteristics of the data signals which are to pass along the channel.

In a further aspect of the invention there is provided waveguide apparatus to allow the passage of data signals therethrough, said waveguide including at least one channel along which the data signals pass, said channel including a first opening at one end and a second opening at a distal end therefrom to allow exit and/or entry of the data signals, said opening and channel substantially rectangular in cross section and wherein in at least a portion of the channel intermediate said openings, the channel cross section is angularly oriented with respect to the openings.

In one embodiment of the invention the angular orientation of the channel is offset 90 degrees about the channel central axis in said intermediate portion of the channel.

In one embodiment the respective axes between opposing sides of the said channel in cross section in said intermediate portion of the channel are perpendicular to the respective axes of the channel in cross section at said openings.

In one embodiment at the interface of the parts which form the waveguide, there is provided a recessed portion on either side of the formation which is used to form the channel. In one embodiment each recessed portion is formed to run along the length of the said formation. Typically the recessed portions are offset from the edge of the formation and are provided to act as collecting means to prevent sealant used to join the parts together from reaching or spreading into the channel formed by the formations when the parts are joined together.

In one aspect of the invention which may be used independently or in combination with the first aspect of the invention, there is formed a ridge portion at or adjacent to the channel formation on at least one of the parts used to form the waveguide.

Preferably a ridge is provided on both sides of the formation and said ridges runalong the length of the formation.

Typically ridges are provided on both parts, adjacent the formation, said ridges located such that when the parts are brought into engagement and are in the correct position, respective ridges on the two parts come into contact. Preferably the seal between the parts insofar as the formation of the channel is concerned is achieved by the contact between the ridges alone, rather than any other areas of the parts. This therefore ensures that an accurate and effective join is created.

In one embodiment the ridges are formed such that with respect to the surfaces of the respective parts which are to be brought together, the top of the ridge protrudes from the remainder of said surface.

In one embodiment, one or more location means can be provided on the respective parts such that when the parts are brought together and the location means on the respective parts are in alignment and/or engaged, the correct location of the formations and the ridges is assured.

The provision of the ridges ensures that good contact is made between the parts and a high level of conductivity between the parts is achieved.

In a further aspect of the invention there is provided waveguide apparatus to allow the passage of data signals there through, said waveguide including at least one channel along which the data signals pass, said channel including a first opening at one end and a second opening at a distal end therefrom to allow exit and entry of the data signals, wherein intermediate said openings there is formed at least one recess portion which is located along a side of the channel.

Typically recess portions are provided along opposing sides of the channel.

The invention allows the manufacture of the product parts to be made easier while at the same time reducing the sensitivity of the product formed. It allows the throughput of production to be improved and improves the receptability of the manufacturing process.

Figure 1B:
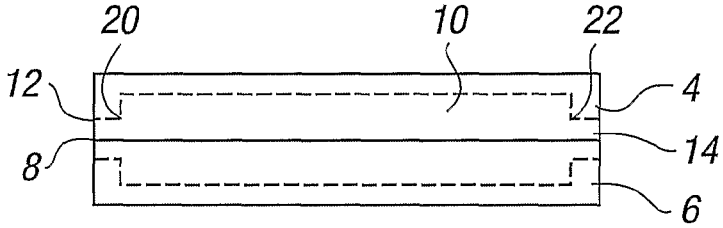
Figure 2A:
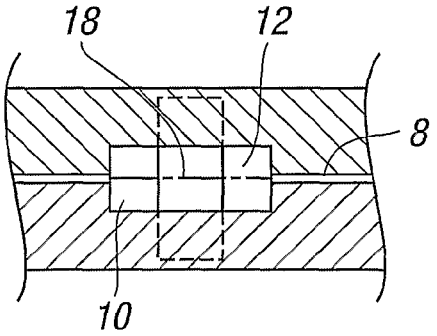
Figure 2B:
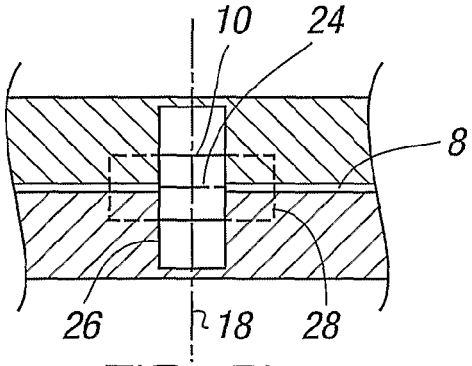
Figure 2C:
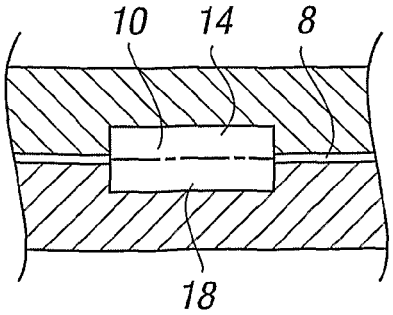
Figure 3:
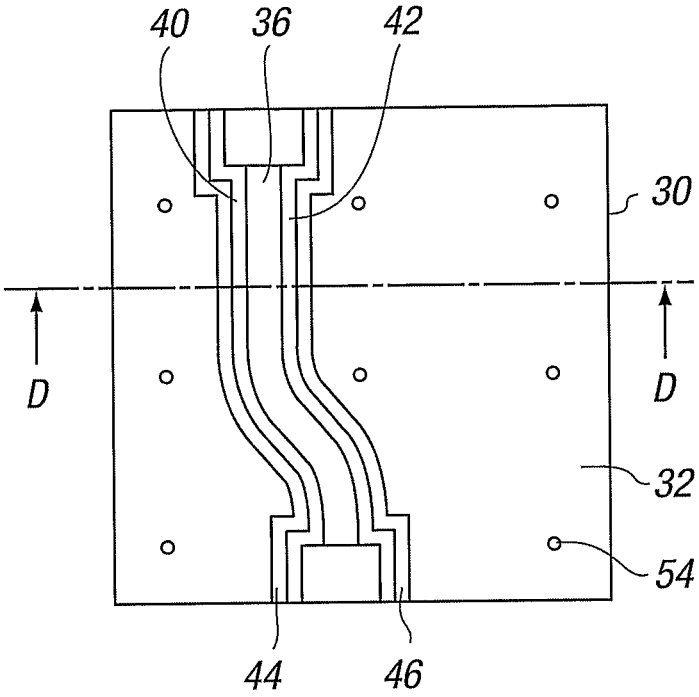
Figure 4:
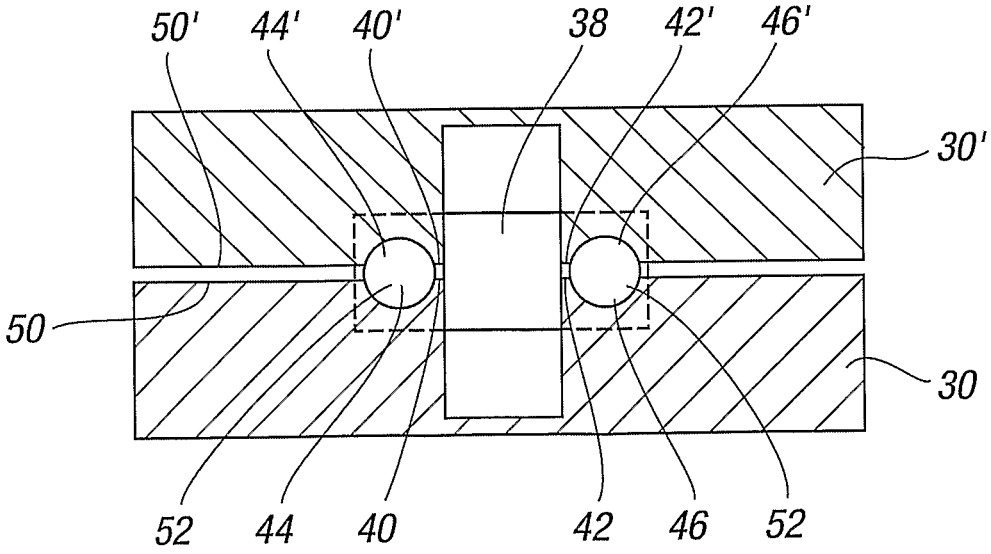

Specific embodiments of the invention are now described with reference to the accompanying drawings, wherein FIGS. 1*a-b* illustrate in plan and elevation in a schematic manner a waveguide with a channel in accordance with one embodiment of the invention;

FIGS. 2*a-c* illustrate the cross sectional shape of the waveguide channel of FIG. 1 at locations on line AA, line BB and line CC respectively;

FIG. 3 illustrates one of the parts used to form a waveguide in accordance with another aspect of the invention; and FIG. 4 illustrates the waveguide formed using the part of FIG. 3 in cross section on line DD.

Referring now to the drawings there is shown in FIGS. 1*a* and *b* in a schematic manner a waveguide 2 which is formed of two, typically cast, metal alloy parts 4, 6. However, the parts could alternatively be moulded or machined. The parts are joined together along the interface 8. Defined within each of the parts is a formation, which when joined to the other part forms a channel 10 which passes from one opening 12 to another 14 and along which data signals pass and are guided. In use the openings are required to be in a particular orientation, typically the same orientation for each opening. This is necessary to allow the data signals to be provided at the required polarity at the openings.

However the orientation of the channel at the openings is commonly not the preferred orientation in terms of the location of the mechanical interface 8 between the parts as it requires that the interface intersects the shorter opposing walls of the rectangular cross section channel. It is therefore preferred that the majority of the channel is oriented with respect to the interface such that the interface intersects the opposing longer side walls of the channel.

The current applicants have appreciated this and they have optimised the performance of the waveguide and at the same time improved the mechanical location of the parts of the waveguide as is illustrated with respect to FIGS. 1*a* and *b* and 2*a-c*.

Referring to FIGS. 2*a* and 2*c* the orientation and shape of the opening 12 and opening 14 are respectively shown and it will be appreciated that the orientation is such that the first longer axis 18 of the channel at each opening 10 is parallel with the interface 8 between the parts 4, 6 of the waveguide. This orientation ensures that the data signals emit from and enter into the channel at the required polarity. However intermediate the openings 12, 14 at transition portions 20, 22 the orientation of the rectangular shaped channel 10 is changed through 90 degrees about the centre axis 24 as shown in FIG. 2*b* such that the first longest or longitudinal axis of the channel 10 in cross section now lies perpendicular to the interface 8 and this is the case along the length of the portion of the channel between the transition portions. This means that the interface now intersects the longer side walls 26, 28 of the channel as is desired for improved mechanical and electrical properties. Typically, and as shown in the figures, the orientation of the channel as shown in FIG. 2*b* is maintained for as great a length of portion of the channel as possible so that the distance between the transition locations 20, 22 on the channel is as great as practically possible without affecting the provision of the data signals.

FIGS. 3 and 4 show a further aspect of the invention which may be used in conjunction with the aspect as shown in FIGS. 1*a*-2*c* or may be used independently of the same in other waveguides.

In FIG. 3 there is shown a plan view of one part 30 of a waveguide, with the face 32 which is shown being that which is brought into contact with the other part 34 to form the waveguide shown in FIG. 4. The part 30 has a formation 36 which defines one half of the channel 38 and which, in this case has the transition locations and change of orientation as has previously been described with reference to FIGS. 1*a*-2*c*. Running along each side of the formation is a ridge 40, 42 and to the offside of each ridge from the formation 36 there is provided a linear recess 44, 46 respectively.

Ridges 40', 42' and recesses 44', 46' are also provided on the opposing part 30' and are provided at the same locations such that when the two parts are brought together as shown in FIG. 4 the respective ridges 40,40' and 42,42' contact and provide an effective conductive join between the two parts. Also, the free ends of the ridges may slightly protrude from the surfaces 50, 50' so as to ensure that the ridges make clean contact.

A sealing medium may be introduced between the surfaces 50, 50' which acts to fill any gap and provide a conductive path between the surfaces. The linear recesses form, in combination, a trough 52 which acts to collect any excess sealing medium and prevent the same from reaching the waveguide channel 38. Location means 54 can be provided to allow mechanical location of the parts 30, 30' to further ensure that the parts are correctly located.

Although FIGS. 3 and 4 show the waveguide being formed from two parts, with the interface between the same located intermediate the ends of opposing side walls of the channel, in another embodiment the waveguide may be formed from a first part which has the channel base and the two opposing side walls formed therein and a second part which provides the top of the channel when placed thereon such that the interface between the first and second parts is located at the end of the opposing side walls rather than intermediate the ends of the same.

The invention as herein described therefore provides a waveguide with significant advantages in terms of the passage of the data signals and also in the mechanical formation of the waveguide itself.

The invention claimed is:

1. Waveguide apparatus to allow the passage of data signals therethrough, said waveguide comprising:

at least one channel along which the data signals pass, said channel including a first opening at one end and a second opening at a distal end therefrom to allow exit and entry of the data signals, at least one of said openings having a first axis longer than a second, perpendicular, axis, and wherein intermediate said openings there are provided at least two transition portions spaced apart along the channel, and at the transition portions a longitudinal axis of the channel in cross section is offset to the first axis of at least one of the openings such that a cross-sectional shape of the channel is rotated about a center axis of the channel in cross section.

2. Apparatus according to claim 1 wherein said longitudinal axis of the channel in cross section is offset to be substantially perpendicular to said first axis of at least one of the openings.

3. Apparatus according to claim 2 wherein said longitudinal axis of said channel is perpendicular along a majority of channel length.

4. Apparatus according to claim 1 wherein said waveguide is formed from two parts, and when each of the parts is brought together said channel is formed.

5. Apparatus according to claim 4 wherein an interface between the parts intersects opposing shorter walls of said channel at and adjacent to the respective openings and then intersects opposing longer walls of said channel along the remainder of said channel.

6. Apparatus according to claim 4 wherein one of the two parts of the waveguide includes three sides of said channel and the other part of the waveguide completes the channel sides when placed in position with the first part.

7. Apparatus according to claim 1 wherein the rotation of the cross-sectional shape of said channel is a rotation of 90°.

8. Apparatus according to claim 1 wherein the respective transition portions are located adjacent to respective openings of said channel.

9. Apparatus according to claim 1 wherein the transition portions are formed integrally with parts used to form said waveguide.

10. Apparatus according to claim 9 wherein recess portions are offset on either side of respective edges of a channel formation and provided to act as collecting means to prevent sealant used to join the parts together from reaching or spreading into said channel formed by the formation when the parts are joined together.

11. Apparatus according to claim 9 wherein there is formed a ridge portion at or adjacent to both sides of a channel formation and a seal between the parts insofar as the formation of the channel is concerned is achieved by contact between the ridges.

12. Apparatus according claim 1 wherein the transition portions are separate components which are fitted to parts used to form said waveguide.

13. Apparatus according to claim 1 wherein the channel shape is varied to form any or any combination of bends, and/or filters.

14. Apparatus according to claim 1 wherein at an interface of parts which form said waveguide, there is provided a recess portion which runs along at least one side of said channel.

15. Waveguide apparatus for passage of data signals therethrough, said waveguide comprising:

at least one channel along which the data signals pass, said channel including a first opening at one end and a second opening at a distal end therefrom to allow exit and/or entry of the data signals, said openings and channel substantially rectangular in cross section and wherein at least two spaced apart portions of the channel intermediate said openings, the channel cross section shape is angularly oriented with respect to that at the respective openings.

16. Apparatus according to claim 15 wherein the angular orientation of said channel is offset 90 degrees about a channel central axis in said intermediate portion of said channel.

17. Apparatus according to claim 16 wherein respective axes between opposing sides of said channel in cross section in said intermediate portion of said channel are perpendicular to respective axes of said channel in cross section at said openings.

* * * * *